United States Patent [19]

Abo et al.

[11] Patent Number: 4,562,814

[45] Date of Patent: Jan. 7, 1986

[54] SYSTEM AND METHOD FOR CONTROLLING FUEL SUPPLY TO AN INTERNAL COMBUSTION ENGINE

[75] Inventors: Toshimi Abo, Yokohama; Takashi Ueno, Yokosuka, both of Japan

[73] Assignee: Nissan Motor Company, Limited, Yokohama, Japan

[21] Appl. No.: 576,474

[22] Filed: Feb. 2, 1984

[30] Foreign Application Priority Data

| | | | |
|---|---|---|---|
| Feb. 4, 1983 | [JP] | Japan | 58-16150 |
| Aug. 24, 1983 | [JP] | Japan | 58-153061 |
| Aug. 24, 1983 | [JP] | Japan | 58-153062 |

[51] Int. Cl.[4] ..... F02B 3/00

[52] U.S. Cl. ..... 123/488; 123/494; 123/492; 123/486

[58] Field of Search ..... 123/482, 488, 480, 486, 123/478, 492, 494

[56] References Cited

U.S. PATENT DOCUMENTS

| | | | |
|---|---|---|---|
| 3,661,126 | 5/1972 | Baxendale | 123/492 |
| 3,960,120 | 6/1976 | Aono | 123/488 |
| 4,048,964 | 9/1977 | Kissel | 123/482 |
| 4,112,879 | 9/1978 | Assenheimer | 123/488 |
| 4,357,923 | 11/1982 | Hideg | 123/492 |
| 4,370,968 | 2/1983 | Nakatomi | 123/488 |
| 4,402,294 | 9/1983 | McHugh | 123/478 |
| 4,434,768 | 3/1984 | Ninomiya | 123/492 |
| 4,481,929 | 11/1984 | Hasegawa | 123/488 |

*Primary Examiner*—Ronald B. Cox

*Attorney, Agent, or Firm*—Schwartz, Jeffery, Schwaab, Mack, Blumenthal & Evans

[57] ABSTRACT

A method and system for controlling an amount of fuel supplied into an internal combustion engine. The system comprises: (a) first means for detecting and signalling an air quantity sucked into an intake passage of the engine; (b) second means for storing at least one first dynamic characteristic model expressing a transfer function defined between a detected air quantity value and intake air quantity actually sucked into each engine cylinder; (c) third means for calculating an actual intake air quantity to be sucked into each engine cylinder from the detected value of said first means and the first dynamic characteristic model stored within said second means; (d) fourth means for storing at least one second dynamic characteristic model expressing a transfer function defined between a signal corresponding to an amount of fuel required for the engine and actual amount of fuel sucked into each engine cylinder; (e) fifth means for calculating the amount of fuel required for the engine using an intake air quantity value calculated by the third means; (f) sixth means for calculating an amount of fuel to be supplied to the engine from the required amount of fuel calculated by the fifth means and from the second dynamic characteristic model stored within the fifth means; and (g) seventh means for actually supplying the amount of fuel in response to the signal based on the calculation result of sixth means.

40 Claims, 19 Drawing Figures

SYSTEM AND METHOD FOR CONTROLLING FUEL SUPPLY TO AN INTERNAL COMBUSTION ENGINE

BACKGROUND OF THE INVENTION

1. Field of the Invention

The present invention relates to a system and method for controlling fuel supply to an internal combustion engine which compensates for any imbalance between intake air and fuel quantities actually sucked into each engine cylinder due to their dynamic characteristics within an intake air system of the engine.

2. Description of the Prior Art

Conventional fuel supply control system for internal combustion engines are exemplified by Japanese Publication No. 53-102416, 55-35165, and 55-134718 the disclosures of which are incorporated by reference.

FIG. 1 shows a conventional fuel supply control systems for an internal combustion engine. In FIG. 1, numeral 1 denotes an air cleaner located upstream of an intake air passage 2, the intake air passage 2 being disposed between the air cleaner 1 and an inlet port of each engine cylinder 6. The numeral 3 denotes a throttle valve, and numeral 4 denotes an airflow meter which outputs an intake air quantity indicative signal $S_1$ whose level changes according to an intake air quantity passing through the intake air passage 2. Numeral 5 denotes a fuel injection valve which injects fuel toward a corresponding engine cylinder 6. The amount of fuel injected depends on a pulsewidth of a fuel injection quantity indicative signal $S_5$ to be described later. Numeral 7 denotes an engine speed sensor which outputs an engine revolution number indicative signal $S_2$ in synchronization with the rotation of a crankshaft of the engine. In addition, numeral 8 denotes an arithmetic operation unit (ALU) comprising a microcomputer having a Central Processing Unit (CPU), memory such as a Read Only Memory (ROM) and Random Access Memory (RAM), and an Input/Output circuit. The arithmetic operation unit 8 receives various sensor signals including the intake air quantity indicative signal $S_1$ and engine revolution number indicative signal $S_2$, calculates an amount of fuel injected to the engine according to the current engine operating condition, and outputs the fuel injection quantity signal $S_5$ to each fuel injection valve 5.

The arithmetic operation of calculating an amount of fuel to be actually injected through each fuel injection valve 5 in the arithmetic opertion unit 10 is carried out in the following manner.

Supposing that Q indicates an intake air quantity obtained by the air quantity indicative signal $S_1$ measured by the airflow meter 4, N indicates an engine speed obtained from the engine revolution number indicative signal $S_2$, and K indicates a correction coefficient, then a fuel injection quantity Tp (corresponding to a pulsewidth of the signal $S_5$ sent to each fuel injection valve 5) is calculated as shown in the following equation:

$$Tp = K\frac{Q}{N} \tag{1}$$

wherein the coefficient K is a correction coefficient according to engine operating conditions, e.g., an engine temperature, etc.

As shown in the equation (1), the fuel injection quantity Tp is set chiefly depending on the intake air quantity Q and engine speed N with a correction factor of, e.g. engine temperature and concentration of an exhaust gas component by which the above-described basic fuel injection quantity is multiplied.

It should be noted, however, that the conventional fuel supply control system shown in FIG. 1 controls the fuel injection quantity by using the intake air quantity signal 4 outputted by the airflow meter $S_1$ directly as a signal indicating the current intake air quantity and on the assumption that the injected fuel via the fuel injection valve 5 is sucked into the cylinder 6 without a time delay.

In other words, in the conventional fuel supply control system of FIG. 1 the intake air quantity Q is a measurement value obtained from is indicative of total engine intake air. The airflow meter 4 and the amount of fuel injected by each injection valve 5 which corresponds to the pulsewidth $T_p$) injected into the intake air passage 2 and may not represent the amount of fuel actually sucked into each cylinder 6.

Therefore, although it is possible to accurately control the amount of injected fuel to the engine in a normal steady state, an error due to dynamic characteristics of the intake air and fuel supply occurs during operation in a transient state. Consequently, during transient operation, the air-fuel mixture ratio may deviate from a target value, adversely effecting fuel consumption, exhaust gas purification, and driving performance (drivability).

SUMMARY OF THE INVENTION

With the above-described problem in mind, it is a main object of the present invention to provide a system and method accurately controlling the amount of fuel supplied to the engine according to the actual intake air quantity of the engine cylinders the actual amount of fuel supplied to each engine cylinders.

These and other objects and advantages may be realized by providing a fuel supply control system comprising: (a) a first means for calculating an actual quantity of intake air sucked into each engine cylinder (Ac(n)) on a basis of an intake air quantity indicative signal outputted by a first sensor for detecting and signalling the intake air quantity sucked into an intake air system of the engine and an air dynamic characteristic model (Ga) representing the dynamic characteristic of the intake air sucked into each engine cylinder obtained by the first means; (b) a second means for calculating a currently required amount of fuel for each engine cylinder (Fc(n)) on a basis of a value of the actual quantity of intake air obtained from said first means; and (c) a third means for calculating an amount of fuel to be currently supplied into each engine cylinder (Ff(n)) on a basis of the currently required amount of fuel for each engine cylinder calculated by the second means and a fuel dynamic characteristic model representing the dynamic characteristic of fuel from the appearance of the output fuel of a fuel supplying means to the quantity of fuel actually sucked into each engine cylinder by the output fuel of the fuel supplying means and outputting the pulse signal representing the amount of fuel to be currently supplied into the engine to the fuel supplying means.

BRIEF DESCRIPTION OF THE DRAWINGS

A more complete understanding of the present invention may be obtained from the following description taken in conjunction with the attached drawings in which like reference numerals designate corresponding elements and in which.

DETAILED DESCRIPTION OF THE PREFERRED EMBODIMENTS

Reference will be made to the attached drawings in order to facilitate understanding of the present invention.

Figure 2A:
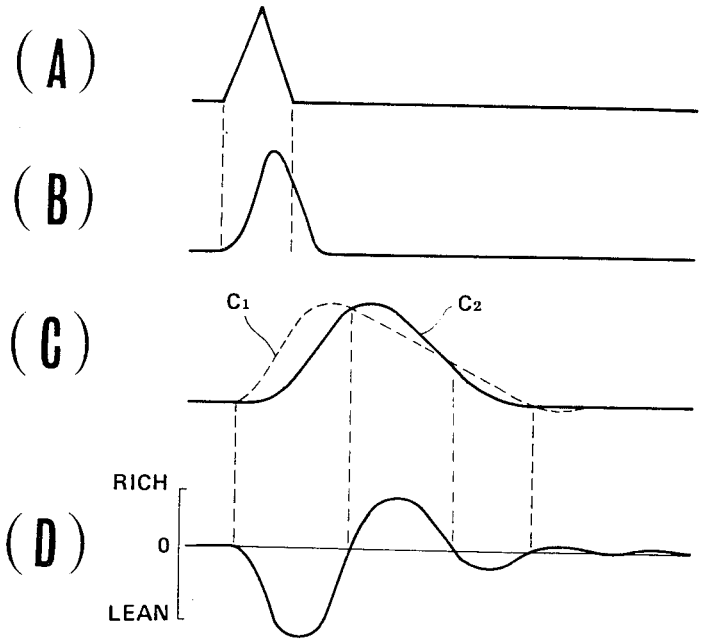
FIG. 2(A) is an example showing dynamic characteristics of intake air quantity and fuel quantity injected into the engine when the conventional fuel supply control system is applied to the engine.

FIG. 2(A) shows change patterns of air-and-fuel dynamic characteristics within the intake air system of the engine.

For example, an opening angle of the throttle valve within the intake air passage 2 is changed from a fully closed state to a fully open state as shown in (A) of FIG. 2(A) with respect to time.

At this time, the flap-type airflow meter 4 will output a signal according to the change in the throttle valve 3 as shown in (A) of FIG. 2A as shown in (B) of FIG. 2(A). Furthermore, the actual intake air quantity changes as shown by a dotted line $C_1$ of (C) of FIG. 2(A).

Figure 1:
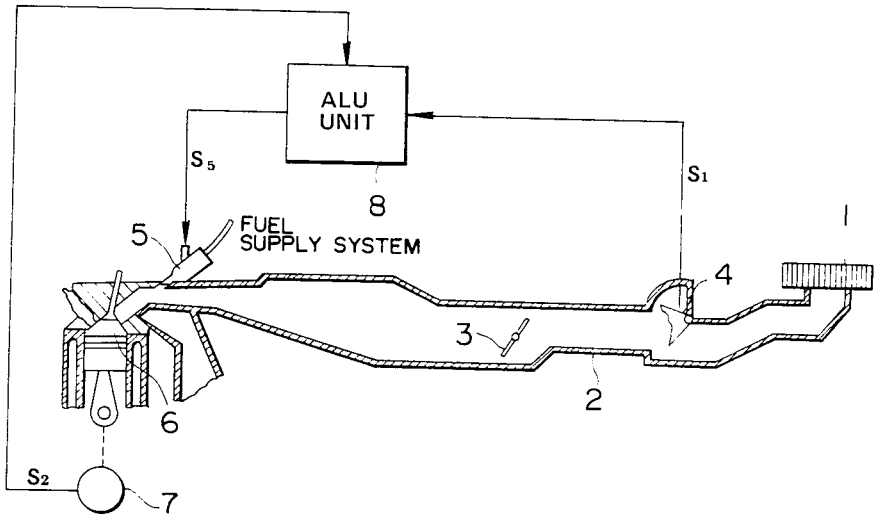
FIG.1 (PRIOR ART)
FIG. 1 is a simplified block diagram of a conventional fuel supply control system for an internal combustion engine.

On the other hand, fuel supplied by the conventional fuel supply control system shown in FIG. 1 is injected according to the signal received from the airflow meter 4 with a substantially negligible delay of time. However, since the injected fuel has a different dynamic characteristic from air, the amount of fuel actually sucked into the engine cylinders is shown in a solid line $C_2$ of (C) of FIG. 2(A) and thereby does not agree with the change in the intake air quantity shown by $C_1$.

Consequently, the air-fuel mixture ratio as shown in (D) of FIG. 2(A) results which deviates from a target value (e.g., stoichiometric air-fuel mixture ratio).

Figure 3:
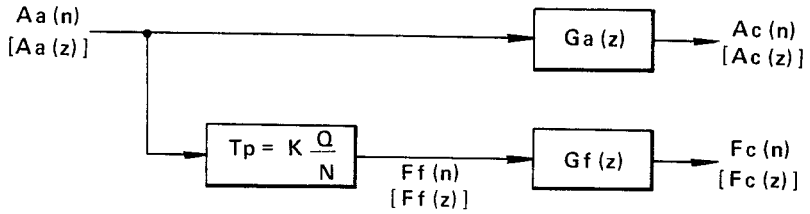
FIG. 3 is a systematic drawing showing the air-and-fuel dynamic characteristics within the intake air system of the engine.

FIG. 3 shows a systematic diagram showing the above-described dynamic characteristics.

In FIG. 3, the intake air quantity Ac(n) for the output Aa(n) of the airflow meter 4 can be expressed as follows by using a transfer function Ga(Z) which depicts an intake air dynamic characteristic.

$$Ac(Z)=Ga(Z)Aa(Z) \quad (2)$$

It should be noted that (n) denotes a sampling period of a fuel supply control system, n means the current sampling period, (n−1) means the immediately preceding sampling period, and (n+1) means the subsequent sampling period. In addition, Ac(Z) and Aa(Z) are Z-transforms of Ac(n) and Aa(n) respectively.

In addition, an actual amount of fuel sucked into each cylinder Fc(n) for the amount of fuel injected by means of the injection pulsewidth Tp calculated by a fixed algorithm Tp=K Aa/N can be expressed as follows by using a transfer function Gf(Z) which depicts the fuel dynamic characteristic:

$$Fc(Z)=Gf(Z)Ff(Z) \quad (3)$$

wherein Fc(Z) and Ff(Z) are Z-transforms of Fc(n) and Ff(n), respectively.

In a case when both Ga(Z) and Gf(Z) are not the same form in the equations (2) and (3), the rate of the intake air quantity and fuel quantity within each cylinder 6 changes so that the air-fuel mixture ratio deviates from a target value during transient operation, e.g., from engine idling to normal running, etc.

Figure 4:
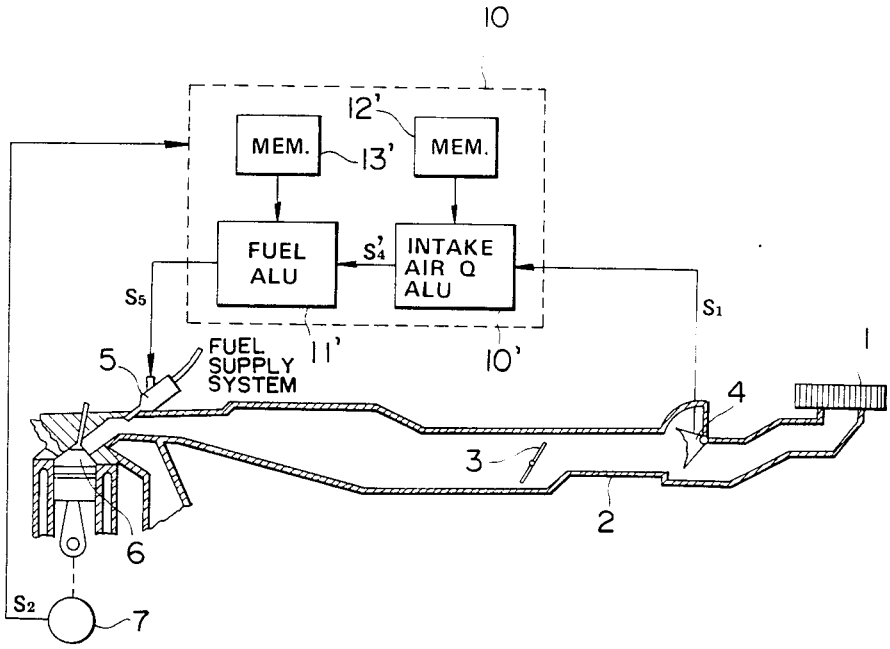
FIG. 4 is a simplified block diagram showing a first preferred embodiment of the present invention.

FIG. 4 shows a functional block diagram of a first preferred embodiment of the fuel supply control system according to the present invention.

In FIG. 4, numeral 10 denotes an arithmetic operation unit comprising intake air quantity arithmetic operation section 10', fuel quantity arithmetic operation section 11', and memory sections 12' and 13'.

These sections are expressed in terms of their functions. Actually, the arithmetic operation unit 10 comprises a microcomputer.

The intake air quantity arithmetic operation section 10' (INTAKE AIR Q ALU) calculates an actual intake air quantity from an air dynamic characteristic Ga obtained previously by an experiment and stored in the memory section 12' and outputs an intake air quantity signal $S_4'$ corresponding to the calculated value from the intake air quantity arithmetic operation section 10'.

The fuel quantity arithmetic operation section 11' (FUEL ALU) calculates the required amount of fuel from the above-described intake air quantity indicative signal $S_4'$, calculates an actual amount of fuel to be injected into each engine cylinder from the fuel dynamic characteristic previously obtained from an experiment and stored in the memory section 13, and outputs the fuel supply indicative signal $S_5$ in a pulse form according to the calculated result in the arithmetic operation unit 10.

The open and close control of the fuel injection valve 5 located so as to correspond to one of the engine cylinders 6, is carried out in response to the fuel supply indicative signal $S_5$ so that the amount of fuel supplied to the engine can be controlled according to an actual amount of intake air actually sucked into each cylinder and actual amount of fuel actually sucked into each engine cylinder during transient operation. Therefore, the balance between the intake air quantity and fuel quantity can be maintained and the air-fuel mixture can be sustained at the target value.

A detailed description of arithmetic operation in the arithmetic operation unit 10 will be made with reference to FIG. 5.

Figure 5:
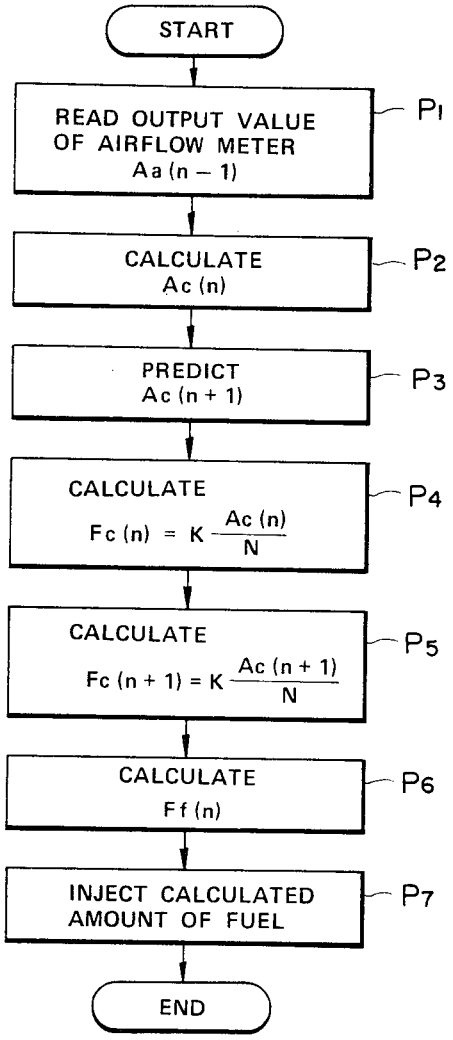
FIG. 5 is an operational flowchart showing arithmetic operations of calculating an amount of fuel to be injected into the engine carried out by the fuel supply control system shown in FIG. 4.

In FIG. 5, in a first step $P_1$, the unit 10 reads the intake air quantity indicative signal $S_1$ of the airflow meter 4, where The obtained value is assumed to be Aa(n−1). n−1 indicates a value obtained in the immediately preceding period of sampling. In step $P_2$, a value of the intake air quantity at this sampling period Ac(n) is calculated.

This calculation is carried out as follows.

The air dynamic characteristic in the intake air system (airflow meter, intake air passage, etc.) of the internal combustion engine can be exemplified in the following equation:

$$Ga(Z) = \frac{d_1Z^{-1} + e_1Z^{-2}}{1 + b_1Z^{-1} + C_1Z^{-2}} \tag{4}$$

The current value Ac(n) of the intake air quantity can be obtained from the above-described value Aa(n−1), a value of two periods prior to the current sampling period Aa(n−2), values of immediately preceeding and two period prior to the current period Ac(n−1), Ac(n−2), the above-described equation (4) and can thus be expressed as follows:

$$Ac(n)=d_1Aa(n-1)+e_1Aa(n-2)-b_1Ac(n-1)-c_1Ac(n-2) \tag{5}$$

Hence, if the above-described coefficients $b_1$, $c_1$, $d_1$, and $e_1$ are previously obtained through an experiment, Ac(n) can be obtained through the above-described arithmetic operation.

Next, in a step $P_3$, the unit 9 executes the airthmetic operation of predicting the subsequent value of the intake air quantity Ac(n+1).

This value can be obtained by using an extraporation formula as follows:

$$Ac(n+1)=2Ac(n)-Ac(n-1)$$

The reason for the arithmetic operation of predicting the subsequent value Ac(n+1) will be described later.

Next in a step $P_4$, the currently required amount of fuel Fc(n) is calculated by substituting the intake air quantity Ac(n) obtained in the step $P_2$ into the following equation (6).

$$Fc(n) = K\frac{Ac(n)}{N} \tag{6}$$

The above-described required amount of fuel Fc(n) is an amount of fuel required by each cylinder according to the actual intake air quantity.

Next, in a step $P_5$, the subsequent required amount of fuel Fc(n+1) is calculated by the following equation (7) by using the subsequent value of intake air quantity Ac(n+1).

$$Fc(n+1) = K\frac{Ac(n+1)}{N} \tag{7}$$

Next in a step $P_6$, an amount of fuel Ff(n) to be actually injected into the engine is calculated in order to supply the above-described required amount of fuel.

Supposing that the fuel dynamic characteristic Gf(Z) be expressed as:

$$Gf(Z) = \frac{d_2Z^{-1} + e_2Z^{-2}}{1 + b_2Z^{-1} + C_2Z^{-2}}, \tag{8}$$

the amount of fuel to be injected into the engine at this time Ff(n) can be expressed in the following equation (9).

$$Ff(n) = \frac{1}{d_2}[Fc(n+1) + b_2Fc(n) + c_2Fc(n-1) - e_2Ff(n-1)] \tag{9}$$

Therefore, if the above-described coefficients $b_2$, $c_2$, $d_2$, and $e_2$ are previously obtained through an experiment, Ff(n) can be obtained through the arithmetic operation.

It should be noted that the purpose of the arithmetic operation of predicting the subsequent value Ac(n+1) in the step $P_3$ is to arithmetically operate the subsequent value of Fc(n+1) and Fc(n+1), in turn, becomes necessary to obtain Ff(n) in the step $P_6$.

In the above-described first preferred embodiment, since the fuel dynamic characteristic is described as in the equation (8), the arithmetic operation of predicting the subsequent value of Ac(n+1) becomes necessary in the step $P_3$. In a case when the air-and-fuel dynamic characteristics can be expressed in simpler equations, e.g., in a case when a denominator in the equation (8) indicates only $b_2Z^{-1}+c_2Z^{-2}$, Fc(n+1) becomes unnecessary in the equation (9) and therefore the arithmetic operation of the subsequent value of Ac(n+1) becomes unnecessary.

Arithmetic operations of predicting subsequent values, e.g., Ac(n+1) and Fc(n+2) of the subsequent values Ac(n+1) and Fc(n+1) are also possible according to its necessity.

In addition, in the above-described embodiment, a variable vane-type, hot-wire type, or Karman vortex type aerometer may be used alternatively in place of the airflow meter 4 as a sensor for detecting the intake air quantity.

The fuel supply control system of the first preferred embodiment can be applied to such cases where the intake air quantity is not measured directly by using the aerometer described above but is estimated from an intake negative pressure or throttle valve opening angle.

It should be noted that it is more practical to describe the air and fuel dynamic characteristics Ga(Z) and Gf(Z) in the formula which synchronizes with the revolutions of the engine and therefore it is preferable to perform the arithmetic operation of FIG. 5 in synchronization with the engine revolutions.

The above-described dynamic characteristics vary depending on models and configuration of the engine and its fuel supply system and furthermore vary depending on engine operating region so that it is preferable to store a plurality of dynamic characteristic models in the memory sections.

Figure 6:
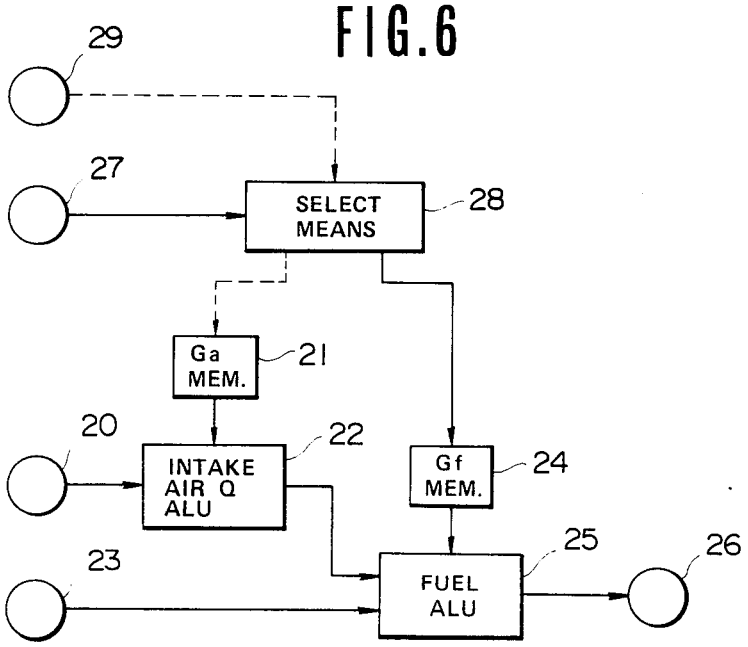
FIG. 6 is a simplified block diagram showing functions on the fuel supply control system of a second preferred embodiment.

A second preferred embodiment of the fuel supply control system according to the present invention will be described with reference to FIG. 6. FIG. 6 shows a functional block diagram of the fuel supply control system of the second preferred embodiment.

In FIG. 6, numeral 20 denotes a sensor which outputs an air quantity indicative signal associated with the intake air quantity, for example, the airflow meter 4. Numeral 21 denotes a first memory which stores the air dynamic characteristic Ga defining the dynamic characteristic between the above-described air quantity indicative signal $S_1$ and intake air quantity actually sucked into each cylinder. Numeral 22 denotes an arithmetic operation means which calculates an actual intake air quantity from the above-described air quantity signal $S_1$ and dynamic characteristic Ga. Numeral 23 denotes a sensor or sensors which detect and signal engine operating variables other than the intake air quantity (engine speed, engine temperature, etc.). Numeral 24 denotes a second memory which stores the fuel dynamic characteristic Gf defining dynamic characteristic between an amount of fuel supplied through a fuel supply means 26, e.g., fuel injection valve provided for each cylinder and the amount of fuel actually sucked into each cylinder. Numeral 25 denotes an arithmetic operation means which calculates an amount of fuel currently required by the engine from data on the engine operating variables supplied from the sensor(s) 23 and from the actual intake air quantity calculated by the arithmetic operation means 22 and calculates the amount of fuel currently required based on the above-described fuel dynamic characteristic Gf. The fuel supply means 26 (e.g., fuel injection valve) supplies an amount of fuel according to the arithmetic operation result of the arithmetic operation means 25. Numeral 27 denotes a detection means for detecting and signalling an engine operating condition which affects one of the fuel dynamic characteristic models Gf (e.g., air temperature, engine temperature, atmospheric pressure, basic air-fuel mixture ratio, etc.) Numeral 28 denotes a selection means for selecting each one of the dynamic characteristic models Ga and Gf according to the current engine operating condition from the contents of the memories 21 and 24 according to the detection signal from the detection means 27.

As described above, the amount of fuel supplied is calculated according to the air dynamic characteristic Ga and fuel dynamic characteristic Gf by selecting each one of the dynamic characteristic models Ga and Gf and an appropriate amount of fuel, corresponding with the actual intake air quantity sucked into each cylinder, can always be supplied to each cylinder even if engine operating conditions are abruptly changed.

It should be noted that it is permissible to change both or either of the air and fuel dynamic characteristic models Ga and Gf.

On the other hand, in a second preferred embodiment, the air-fuel mixture ratio can be positively controlled to a value different from that occurring under stable conditions by changing the form of the dynamic characteristic models.

That is to say, as shown in FIG. 6, another detection means 29 for detecting and signalling an abrupt change in an engine operating condition, e.g., an abrupt acceleration state, is provided so that the selection means 28 is also operated according to the signal from the detection means 29 as shown by a dotted line of FIG. 6. In this way, different dynamic characteristic models Ga and Gf are selected for controlling the air-fuel mixture ratio.

Figure 2B:
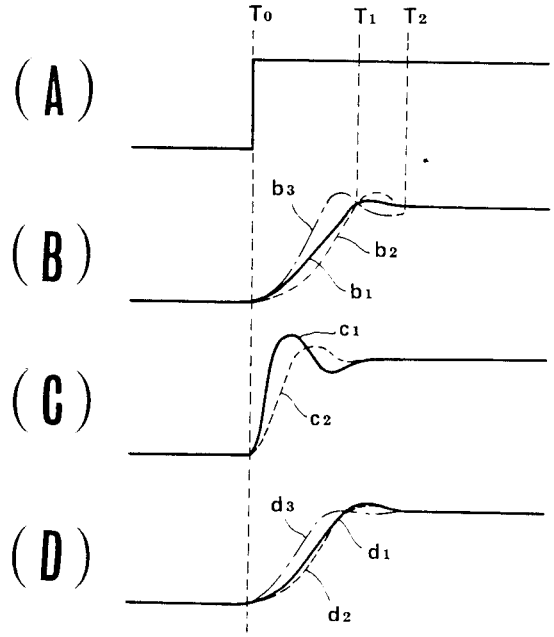
FIG. 2(B) is an example showing the changes in the intake air quantities and fuel injection quantities at different modes of operation in the internal combustion engine.

For example, when the amount of fuel sucked into each cylinder 6 is changed, as shown by the dot-and-dashed line $b_3$ of FIG. 2(B), and the amount of injected fuel is intentionally supplied on the basis of the dynamic characteristic model of $c_1$ of (C) of FIG. 2(B), the amount of fuel actually sucked into each cylinder is intentionally increased as shown by $d_3$ of (D) of FIG. 2(B). Hence, an excessively richer air-fuel mixture can be achieved relative to the air-fuel mixture during stable operation, during an abrupt acceleration. Thus, accleration performance of the engine can be increased. On the other hand, an excessively leaner air-fuel mixture can be achieved during an abrupt deceleration if different dynamic characteristic models Ga and Gf are selected in the same way as described above.

Figure 7:
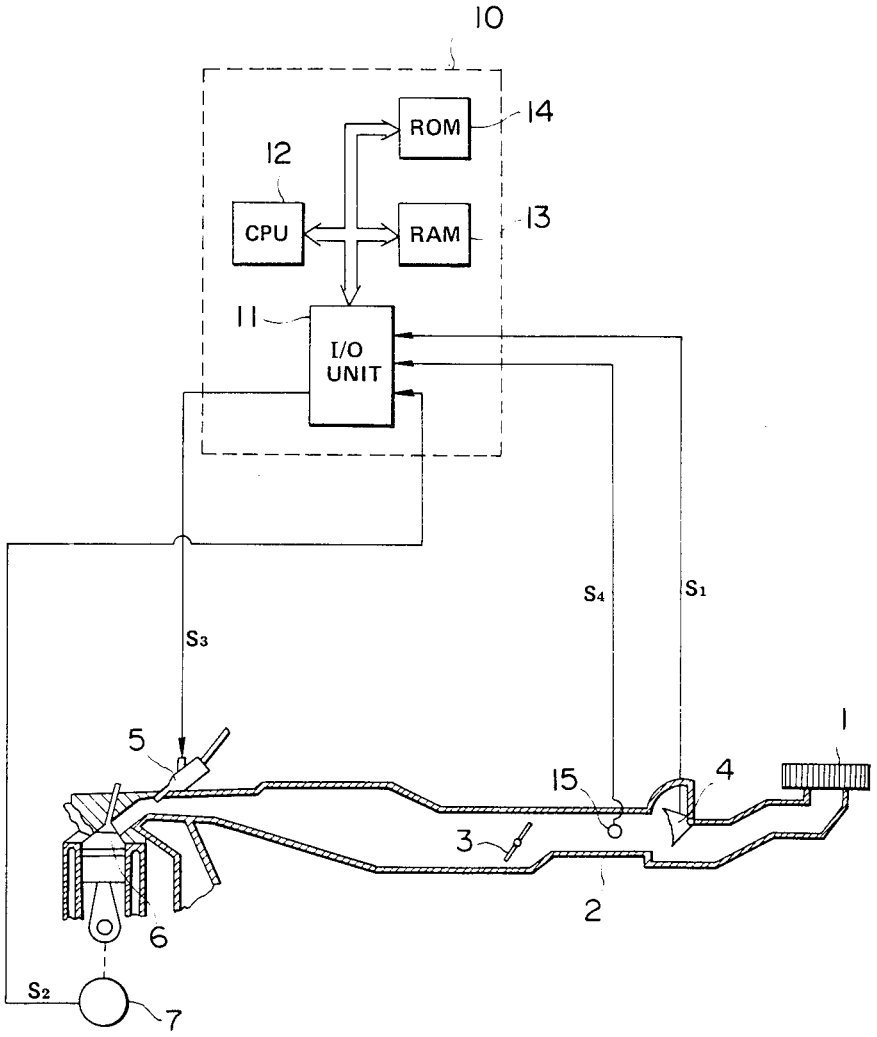
FIG. 7 is a simplified block diagram showing a hardware construction of the fuel supply control system in the second preferred embodiment shown in FIG. 6.

FIG. 7 shows an example of hardware construction of the second preferred embodiment.

In FIG. 7, numeral 15 denotes a temperature sensor for detecting and signalling an intake air temperature and outputs an intake air temperature indicative signal $S_4$.

In addition, the arithmetic operation unit 10 comprises a microcomputer having an input/output unit 11, CPU 12, RAM 13, and ROM 14.

The arithmetic operation unit 10 receives an intake air quantity signal $S_1$, engine speed indicative signal $S_2$, intake air temperature indicative signal $S_4$ and a signal relating to engine operating variables such as an engine cooling water temperature (not shown), and outputs a fuel injection quantity indicative signal $S_3$ after carrying out of a predetermined arithmetic operation. The opening and closing of each fuel injection valve 5 is controlled in accordance with the pulsewidth of the fuel injection quantity indicative signal $S_3$ and the amount of fuel required by each cylinder is supplied through an associated fuel injection valve 5.

Figure 8:
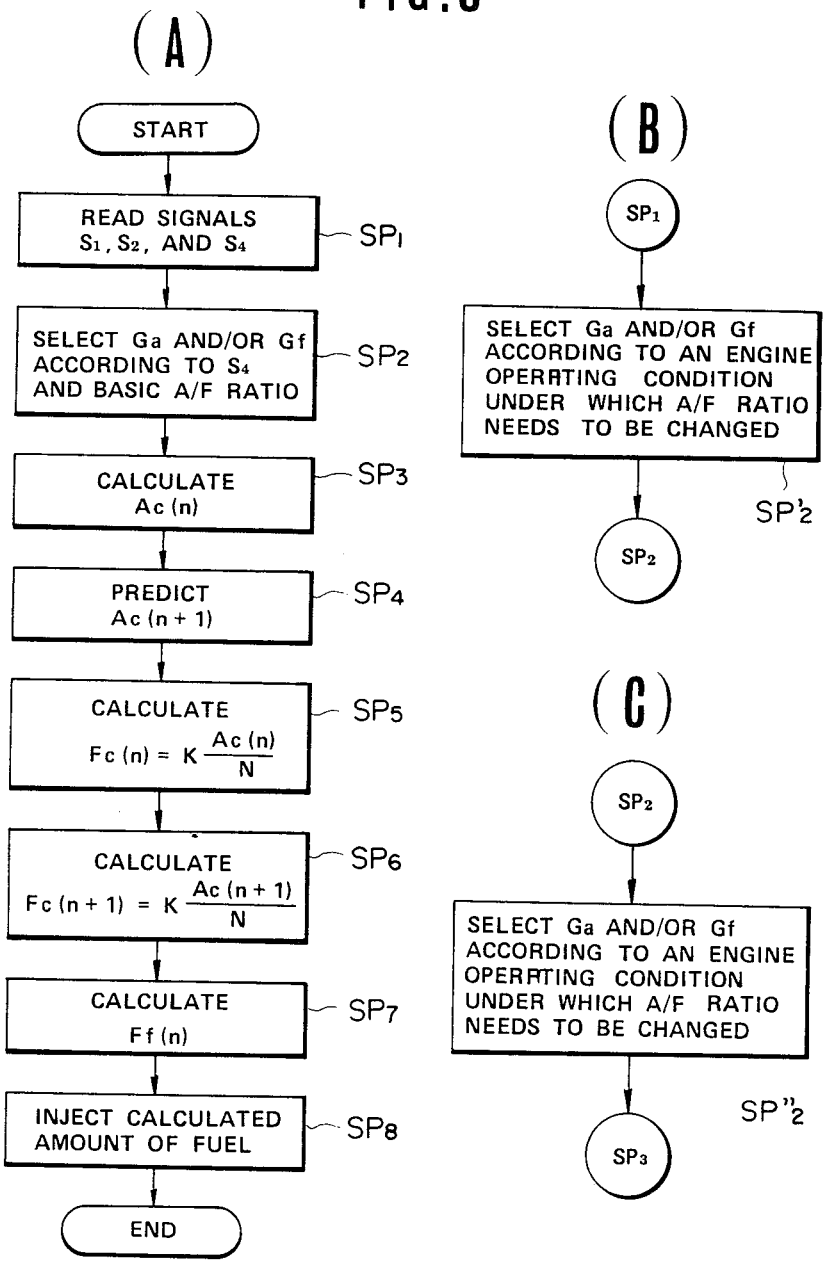
FIGS. 8(A) through 8(C) are operational flowcharts showing arithmetic operations of calculating the amount of fuel to be injected into the engine carried out by the fuel supply control system shown in FIG. 7.

A detailed description of the predetermined arithmetic operation described above is made with reference to flowcharts of FIGS. 8(A), 8(B), and 8(C).

Each predetermined arithmetic operation of FIGS. 8(A), 8(B), and 8(C) is repeated in synchronization with the engine revolution or at equal intervals of time.

In FIG. 8(A), the arithmetic operation unit 10 reads various input signals $S_1$, $S_2$, and $S_4$ in a first step $SP_1$.

Next, in a second step $SP_2$, dynamic characteristic models Ga and Gf are selected which are suited to the current engine operating condition on the basis of the intake air temperature and basic air-fuel mixture ratio.

The basic air-fuel mixture ratio means a target value of the air-fuel mixture ratio control at each stable engine operating condition.

Next in a third step $SP_3$, a value Ac(n) of the intake air quantity at the current sampling period is arithmetically operated on the basis of a value of the air quantity signal $S_1$ read in the step $SP_1$, i.e., Aa(n−1) and air dynamic characteristic Ga selected in the second step $SP_2$. The arithmetic operation is carried out in the following. It should be noted that (n−1) indicates a value measured at the time of the immediately preceding sampling period.

The air dynamic characteristic of intake air system (airflow meter, throttle chamber, intake manifold, etc.) in the internal combustion engine can be expressed by such a quadratic pulse transfer function as described in the first preferred embodiment, that is, $$Ga(Z) = \frac{d_1Z^{-1} + e_1Z^{-2}}{1 + b_1Z^{-1} + C_1Z^{-2}}. \quad (10)$$

In addition, a value Ac(n) of the current intake air quantity can be expressed in the following equation (11) from the above-described Aa(n−1), a value Aa(n−2) of two periods prior to the current sampling period Aa(n−2), values of the immediately preceding and two periods prior to the current sampling period Ac(n−1) and Ac(n−2) in the same way as described in the first preferred embodiment.

$$Ac(n)=d_1Aa(n-1)+e_1Aa(n-2)-b_1Ac(n-1)-c_1Ac(n-2) \quad (11)$$

One air dynamic characteristic model can be determined if the above-described coefficients $b_1$, $c_1$, $d_1$, and $e_1$ are determined.

Hence, if a value of each coefficient is previously stored in the ROM 14, the value thereof being suited to typical engine operating conditions and being previously obtained through an experiment, a value suited to the current operating condition may be selected in the step $SP_2$.

Next, in a fourth step $SP_4$, a subsequent intake air quantity value at the subsequent sampling period Ac(n+1) is calculated.

This value can be obtained by using, e.g., an extraporation method using the values obtained at the time of the current sampling period and intake air quantity at the time of the previous sampling period Ac(n) and Ac(n−1).

$$Ac(n+1)=2Ac(n)-Ac(n-1)$$

The reason for the necessity of the arithmetic operation of predicting the subsequent value will be described later.

Next in a step $SP_5$, the current amount of fuel required for each cylinder Fc(n) is arithmetically operated by using the intake air quantity Ac(n) obtained in the step $SP_3$ is shown in the following equation.

$$Fc(n) = K\frac{Ac(n)}{N}$$

The above-described amount of fuel required for each cylinder Fc(n) is an amount of fuel currently required within each cylinder currently corresponding to the actual intake air quantity.

Next, in a step $SP_6$, the subsequent amount of fuel required for each cylinder Fc(n+1) is calculated from the following equation (12) by using Ac(n+1) obtained in the step $SP_4$ in the same way as described in the first preferred embodiment.

$$Fc(n+1) = K\frac{Ac(n+1)}{N} \quad (12)$$

Next in a step $SP_7$, an actual amount of fuel to be currently injected into each cylinder Ff(n) is calculated using the dynamic characteristic Gf in order to supply the above-described required amount of fuel into each cylinder.

For example, if the fuel dynamic characteristic Gf(Z) is expressed in the following equation (13) in the same way as described in the first preferred embodiment; i.e., $$Gf(Z) = \frac{d_2Z^{-1} + e_2Z^{-2}}{1 + b_2Z^{-1} + C_2Z^{-2}}, \quad (13)$$

the current amount of fuel to be injected at this time can finally be expressed in the following equation (14) in the same way as described in the first preferred embodiment; i.e., $$Ff(n) = \frac{1}{d_2}[Fc(n+1) + b_2Fc(n) + c_2Fc(n-1) - e_2Ff(n-1)] \quad (14)$$

However, in a case when the fuel and air dynamic characteristics can be expressed in a simpler equation, e.g., in a case when the denominator in the equation (13) is expressed as $b_2Z^{-1}+C_2Z^{-2}$, Fc(n+1) becomes unnecessary in the equation (14) and hence the arithmetic operation of predicting the subsequent value Ac(n+1) at the subsequent sampling period becomes unnecessary.

Next in a step $SP_8$, a fuel injection signal $S_3$ is outputted whose pulsewidth corresponds to the actual amount of fuel to be currently injected into the engine Ff(n) obtained in the step $SP_7$ and each fuel injection valve 5 carries out the fuel injection obtained in the step $SP_7$ in response to the fuel injection indicative signal $S_3$ shown in FIG. 7.

Next, the selection of the dynamic characteristics Ga and Gf in the above-described step $SP_2$ is described hereinbelow.

The fuel dynamic characteristic is largely affected by a state in which fuel vaporizes and the state of vaporization changes according to the intake air temperature.

For example, as the intake air temperature becomes high, the vaporization is faster than when it is low and a response from the time when the injection of fuel is carried out to the time when the injected fuel is sucked into each cylinder becomes faster.

In addition, the fuel dynamic characteristic will change depending on the basic instantaneous air-fuel mixture ratio. For example, the air quantity per unit of fuel quantity when the basic air-fuel mixture ratio is lean (, i.e., large) is more than when the basic air-fuel mixture is rich (small) and vaporization becomes faster resulting in a quick response as described above.

It is preferable to use two factors of intake air temperature and basic air-fuel mixture ratio as criteria for selecting the fuel dynamic characteristics.

Figure 9:
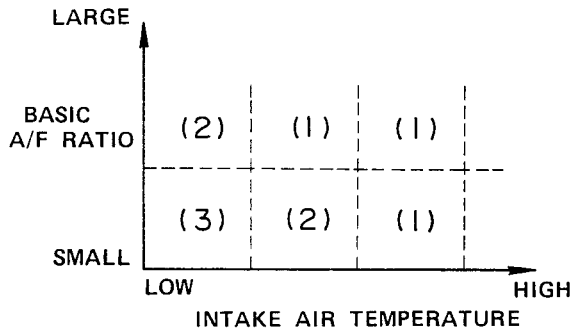
FIG. 9 is a graph showing a relationship between intake air temperature, basic air-fuel mixture ratio, and three kinds of fuel dynamic characteristic models.

For example, as shown in FIG. 9, three kinds of fuel dynamic characteristics (1), (2), and (3) according to the intake air temperature and basic air-fuel mixture ratio (in detail, values of each coefficient used in the steps $SP_3$ and $SP_7$) may be stored and, among these stored values, a value which correspond to the intake air temperature and basic air-fuel mixture ratio at the sampled period of time.

Figure 10:
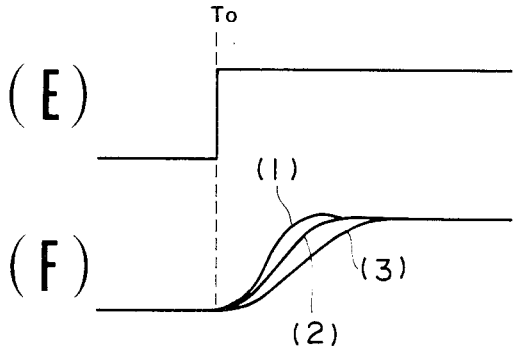
FIG. 10 is an example of dynamic characteristics of the intake air and fuel injected actually into the intake air system shown in FIG. 9.

FIG. 10 shows the change patterns of injected fuel caused by the three kinds of fuel dynamic characteristic models described above. In FIG. 10, plot (E) indicates an output of airflow meter and plot (F) indicates change patterns of injected caused by the three kinds of dynamic characteristic models.

An explanation of engine operating conditions which affect the fuel dynamic characteristic models, other than those described above, follows.

Since in a cross-flow type engine, an engine cooling water serves to warm intake air in the intake air passage 2, the cooling water temperature affects the fuel dynamic characteristic.

In addition, the fuel dynamic characteristic is affected by where the fuel injection valve 5 is disposed, i.e., whether each fuel injection valve is disposed in the vicinity of each intake air valve of the cylinder 6 or whether one fuel injection valve is disposed within a throttle chamber located upstream of the intake manifold of the intake air system.

The air dynamic characterisic is affected by the kinds of sensors used for detecting and signalling the intake air quantity, the mounting configuration between the intake air and exhaust gas passages, and the atmospheric pressure.

The method for positively changing the air-fuel mixture ratio by changing the fuel and air dynamic characteristic models is described hereinbelow.

In place of the step $SP_2$ in FIG. 8(A), or between the steps $SP_2$ and $SP_3$, an alternative step $SP'_2$ or $SP''_2$ in FIG. 8(B) or FIG. 8(C) respectively may be inserted which selects the fuel and/or air dynamic characteristic models according to an output of a sensor which detects and signals that an engine operating condition which involves the change of air-fuel mixture ratio (29 of FIG. 6), has occurred e.g., a sensor which detects and signals an abrupt opening of the throttle valve is inserted so that the air-fuel mixture can be controlled to the smaller (excessively richer) air-fuel mixture ratio or to the larger (excessively leaner) air-fuel mixture ratio.

Therefore, an appropriate control for improving the drivability of the vehicle in which the fuel supply control system is incorporated may be executed when conditions are such that the air-fuel mixture is desired to be slightly richer as in the case of an abrupt acceleration.

Figure 11:
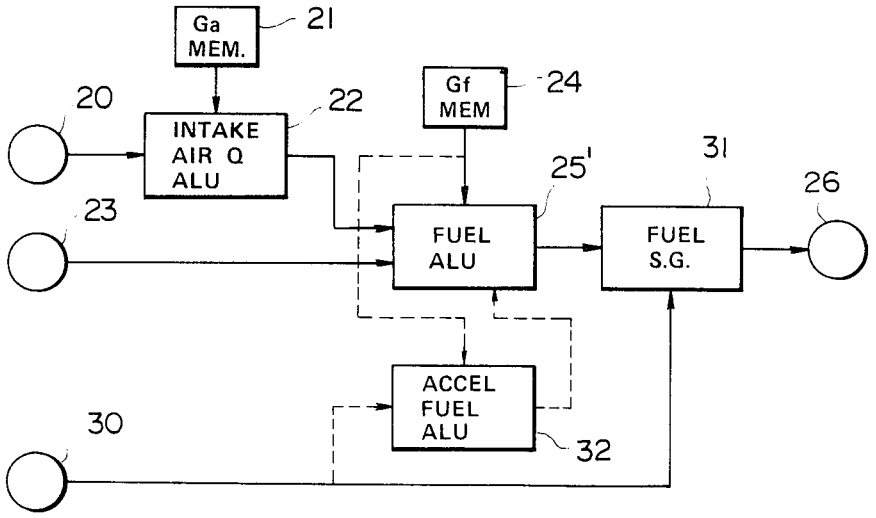
FIG. 11 is a simplified block diagram showing functions of the fuel supply control system of a third preferred embodiment.

FIG. 11 shows a functional block diagram of a third preferred embodiment of the fuel supply control system according to the present invention.

As shown in FIG. 11, the intake air quantity sensor 20 is connected to a first arithmetic operation section 22 (INTAKE AIRQ ALU) which calculates an actual intake air quantity from the above-described air quantity indicative signal outputted from the sensor 20 and air dynamic characteristic Ga stored in the memory 21. A second arithmetic operation section 25' is connected to the memory 24 for storing fuel dynamic characteristics Gf. One or more sensors 23 are provided for detecting and signalling engine operating variables other than intake air quantity (e.g., engine speed, and engine temperatures, etc.). The second arithmetic operation section 25' calculates the required amount of fuel for the internal combustion engine from data on the engine operating variables sent from the sensor(s) 23 and actual intake air quantity obtained by the first arithmetic operation section 22 and calculates the amount of fuel to be currently supplied from the required amount of fuel and the fuel dynamic characteristic Gf stored in the memory (Gf MEM) 24. Another sensor 30 is provided for detecting and signalling when the required amount of fuel for the engine has abruptly increased, for example, a throttle valve opening sensor which outputs a signal which corresponds to a rate of change toward a fully open throttle valve position.

A fuel signal generator 31, connected to the second arithmetic operation section 25' and to the throttle valve opening sensor 30, is provided which outputs a fuel signal according to the arithmetic operation result in the second arithmetic operation section 25'. However, if a signal is received from the throttle valve opening sensor 30, having a level which exceeds a predetermined value an acceleration fuel signal is outputted immediately to the fuel supply means 26. It should be noted that although the acceleration fuel signal may be of a constant value, a more appropriate control can be achieved if a value of the acceleration fuel signal changes with the output signal level of the throttle valve opening sensor 30.

The fuel supply means 26 (such as a fuel injection valve(s)) supplies An amount of fuel corresponding to the output signal of the above-described fuel signal generator 31.

In the fuel supply control system of the third preferred embodiment, a given amount of fuel can additionally and quickly be supplied to the engine when the amount of fuel required by the engine is abruptly increased, e.g., during abrupt acceleration. The given amount of fuel is supplied before the amount of fuel supply is increased on the basis of data on the intake air quantity by means of the second arithmetic operation section 25'.

In this way, even if the fuel dynamic characteristic is slower than the air dynamic characteristic, the fuel supply control system can respond quickly to an abrupt increase in the amount of fuel required by the engine. Consequently, an air-fuel mixture having a desired air-fuel mixture ratio can be supplied to each cylinder.

Furthermore, it should be noted that when the given amount of fuel is supplied during abrupt acceleration, each engine cylinder receives the amount of fuel supply calculated in the arithmetic operation section 25' and, in addition, the given amount of additional fuel supply during acceleration.

Since the second arithmetic operation section 25' outputs the fuel supply signal to the fuel signal generator 31 according to the amount of fuel required by the engine irrespective of the pesence or absence of the given amount of fuel supply at the time of abrupt acceleration, the value of the output signal from the second arithmetic operation section 25' is increased in accordance with the increase of intake quantity with a slight time delay upon the occurrence of abrupt acceleration. Hence, the total amount of fuel supply is excessively increased by the given amount of additional fuel previously supplied so that the air-fuel mixture might become excessively rich (the air-fuel mixture ratio becomes extremely smaller).

To solve the above-described problem, a third arithmetic operation section 32 (ACCEL FUEL ALU) is provided which calculates an amount of fuel actually sucked into each cylinder. This amount is derived from the given amount of additional fuel supply at the time of abrupt acceleration. The arithmetic operation is carried out by using the fuel dynamic characteristic Gf stored within the memory 24 in the same way as described above. When the given amount of additional fuel supply is carried out, the second arithmetic operation section 25' outputs the signal to the fuel signal generator 31 which corresponds to a value calculated on a basis of the amount of fuel supply subtracted by that obtained by the arithmetic operation section 25', itself using the dynamic characteristic Gf stored within the memory 24.

Figure 12:
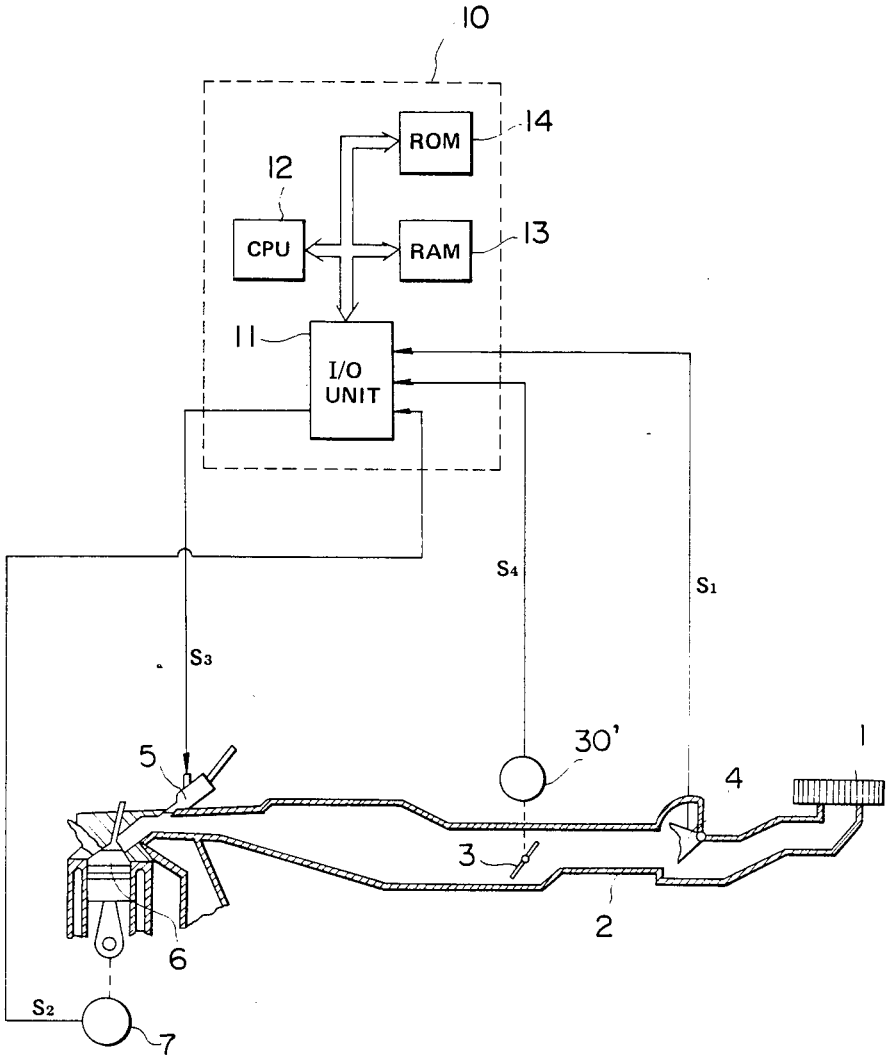
FIG. 12 is a simplified block diagram showing a hardware construction of the fuel supply control system in the third preferred embodiment shown in FIG. 11.

FIG. 12 illustrates a hardware construction of the third preferred embodiment shown in FIG. 11.

In FIG. 12, numeral 30' denotes a throttle switch which outputs a detection signal $S_4$ when the throttle valve 3 changes its opening angle from the fully closed position.

The arithmetic operation unit 10 comprises a microcomputer having the I/O unit, CPU 12, RAM 13, and ROM 14. The arithmetic operation unit 10 receives the air quantity indicative signal $S_1$, engine speed indicative signal $S_2$, detection signal $S_4$, and another signal representing an engine operating variable such as engine temperature signal (not shown), and outputs the fuel signal $S_3$ after execution of a predetermined arithmetic operation. The fuel signal $S_3$ controls the opening and closing the fuel injection valve(s) 5.

It is well known that since the fuel injection valve(s) 5 receives an amount of fuel continuously from a fuel supply system (e.g., fuel pressure regulator) under a constant pressure, the opening time of the fuel injection valve(s) 5 determines the amount of fuel injected to the engine.

Next, a series of arithmetic operations carried out by the arithmetic operation unit 10 in the third preferred embodiment will be described below with reference to operational flowcharts shown in FIGS. 13(A) and 13(B).

Figure 13:
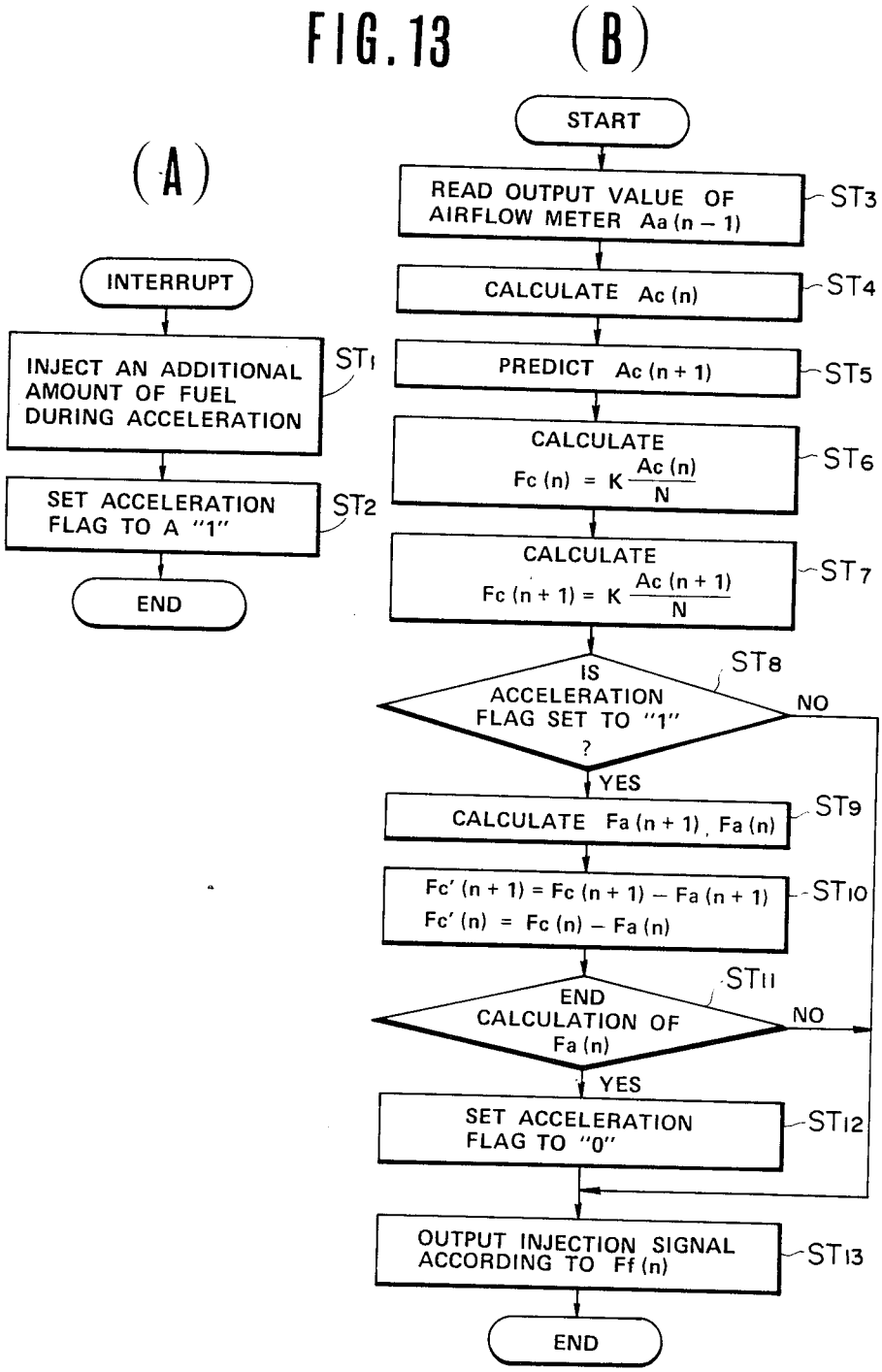
FIGS. 13(A) and (B) are operational flowcharts showing arithmetic operations of calculating the amount of fuel injected into the engine carried out by the fuel control system shown in FIG. 11.

FIG. 13(A) shows an interrupt routine which is executed by interrupting the series of arithmetic operations by the arithmetic operation unit 10 in response to the detection signal $S_4$ of the throttle switch 30' shown in FIG. 12.

In this interrupt routine shown in FIG. 13(A), the given amount of fuel supply at the time of abrupt acceleration is carried out in a first step $ST_1$ and a flag indicating the execution of injection at the time of abrupt acceleration is set to a "1" in a next step $ST_2$.

Next, FIG. 13(B) shows a normal fuel control routine each step thereof being executed either in synchronization with engine revolutions or at a constant intervals of time.

First, in a step $ST_3$, the air quantity signals $S_1$ outputted from the airflow meter 4, i.e., Aa(n−1) is read in. As already described in the first preferred embodiment, (n−1) indicates a value read at the immediately preceding period of sampling.

This means that an output value of the airflow meter 4 previously read is used at this period. It should be noted that the engine speed signal $S_2$ is also read in from the engine speed sensor 7 in this step $ST_3$.

In the next step $ST_4$, a value Ac(n) of the intake air quantity at this period is arithmetically operated.

This arithmetic operation is executed as follows in the same way as described in the first and second preferred embodiments.

The air dynamic characteristics can, for example, be expressed in the following quadruple pulse transfer function:

$$Ga(Z) = \frac{d_1Z^{-1} + e_1Z^{-2}}{1 + b_1Z^{-1} + C_1Z^{-2}} \tag{15}$$

A value Ac(n) of the intake air quantity at this period can be expressed as the following equation (16) from the above-described values Aa(n−1), Aa(n−2), Ac(n−1), Ac(n−2), and the equation (15).

$$Ac(n) = d_1Aa(n-1) + e_1Aa(n-2) - b_1Ac(n-1) - c_1Ac(n-2) \tag{16}$$

The value of Ac(n) can be obtained through the arithmetic operation if the above-described coefficients $b_1$, $c_1$, $d_1$, and $e_1$ are obtained previously through an experiment and stored in the ROM14 or RAM13.

It should be noted that although Ac(n) is shown by approximating Ga(Z) in the form of the equation (15), an approximation which includes the item of $Z^0$ in the numerator of Ga(Z) may alternatively be used. In the latter case, Aa(n), i.e., the value read at this period is used for calculating the value of Ac(n). Next in a step $ST_5$, the arithmetic operation of predicting the subsequent value Ac(n+1) is carried out by using the equation: Ac(n+1)=2Ac(n)−Ac(n−1) in the same way as described in the first and second preferred embodiments.

Next, in a step $ST_6$, the required amount of fuel at this period Fc(n) is calculated by using the equation:

$$Fc(n) = K\frac{Ac(n)}{N}.$$

The above-described required amount of fuel at this period Fc(n) is an amount of fuel actually required within each cylinder corresponding to the actual intake air quantity sucked into each cylinder.

Next in a step $ST_7$, Fc(n+1), i.e., an amount of fuel supply required at the subsequent period of sampling can be calculated from the following equation (17) in the same way as described in the first and second preferred embodiments.

$$Fc(n+1) = K\frac{Ac(n+1)}{N} \tag{17}$$

If the acceleration injection flag is "0" in a step $ST_8$, the arithmetic operation unit 10 calculates the amount of fuel supply Ff(n) to be injected actually for supplying the above-described required amount of fuel supply into each cylinder.

For example, suppose that the fuel dynamic characteristic Gf(Z) expressed in the following equation (18) as described in the first and second preferred embodiments:

$$Gf(Z) = \frac{d_2Z^{-1} + e_2Z^{-2}}{1 + b_2Z^{-1} + C_2Z^{-2}} \tag{18}$$

The amount of fuel supply Ff(n) to be injected at this period of sampling can be expressed in the following equation (19).

$$Ff(n) = \frac{1}{d_2}\left[Fc(n+1) + b_2Fc(n) + c_2Fc(n-1) - e_2Ff(n-1)\right] \tag{19}$$

Therefore, if the above-described coefficients $b_2$, $c_2$, $d_2$, and $e_2$ are previously obtained through the experiment, Ff(n) can be obtained through the arithmetic operation.

A value stored in the ROM 14 etc. is used for each coefficient.

It should be noted that the arithmetic operation of predicting the subsequent value Ac(n+1) in the step $ST_5$ is used for calculating Fc(n+1) in the step $ST_7$ and Fc(n+1) becomes necessary for obtaining the value of Ac(n).

A value of each coefficient described above is a value which is stored in the ROM 14 or RAM 13 after the previous experiment.

Although in the third preferred embodiment the fuel dynamic characteristic is expressed as shown in the equation (18) so that the arithmetic operation in the above-described step $ST_5$ becomes necessary. However, in a case where each of the air and fuel dynamic characteristics can be expressed in a simpler equation, for example, in a case where the denominator is merely expressed in such an equation as $b_2Z^{-1}+c_2Z^{-2}$. Fc(n+1) in the equation (7) becomes unnecessary and then the arithmetic operation of Ac(n+1) becomes unnecessary.

If the acceleration injection flag is "1" in the step $ST_8$, i.e., the additional amount of fuel supply has been carried out, the routine goes to a step $ST_9$ in which Fa(n) and Fa(n+1), i.e., actual amounts of fuel sucked into each cylinder by the additional amount of fuel supply at the time of abrupt acceleration are arithmetically operated.

Next in a step $ST_{10}$, the arithmetic operations of $Fc'(n)=Ff(n)-Fa(n)$ and $Fc'(n+1)=Fc(n+1)-Fa(n+1)$ are executed.

Such calculations are executed from the fuel dynamic characteristic Gf(z) in the same way as the above-described equations (18) and (19).

Next, in the step $ST_{11}$, the arithmetic operation unit 10 determines whether the calculation of Fa(n) in the step $ST_{10}$ should be ended or not.

The determination depends upon whether an influence on the additional amount of fuel at the time of abrupt acceleration becomes sufficiently small, e.g., whether a value of Fa(n) becomes less than a predetermined value.

If the answer is NO in the step $ST_{11}$, the routine goes immediately to the step $ST_{13}$ where the fuel signal $S_3$ is outputted having a pulsewidth which accords with F'c(n) and F'c(n+1). On the contrary, if the answer is YES, the routine goes to the step $ST_{12}$ where the acceleration injection flag is turned to "0" so that the routine from the steps $ST_9$ through $ST_{12}$ does not pass and the control is returned to the normal control.

It should be noted that the normal control is such that the additional amount of fuel at the time of abrupt acceleration is not subtracted if the route from the steps $ST_9$ through $ST_{12}$ is omitted.

In addition, if the additional amount of fuel at the time of abrupt acceleration is varied according to a change rate of the throttle valve opening as described above, a more precise control can be achieved.

In this case, another type of throttle sensor which outputs a signal according to a throttle valve opening rate in place of the throttle switch 30' shown in FIG. 12 and means for detecting and signalling the change rate of the output signal are provided so that the additional amount of fuel supply may be changed according to the change rate of the throttle valve opening.

In this case, the calculation of Fa(n) in the step $ST_9$ may be executed according to the amount of fuel additionally injected at each period of sampling.

Figure 14:
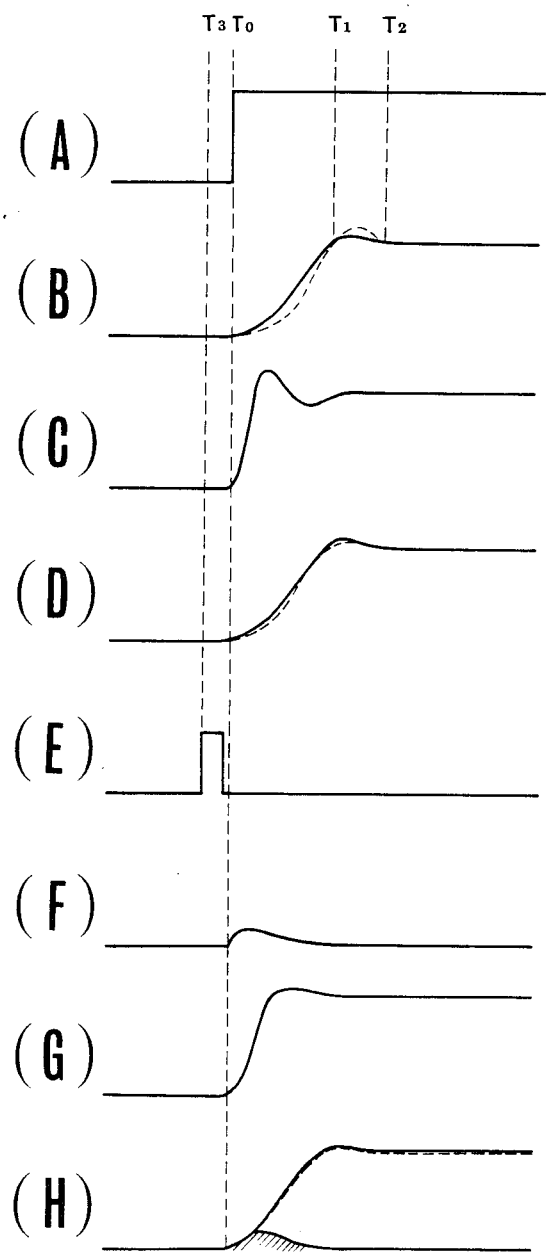
FIG. 14 is a waveform timing chart showing the various changes in intake air sucked into the engine and fuel injected into the engine for explaining the third preferred embodiment.

FIG. 14 shows change patterns of the intake air quantity and amount of fuel supply in the internal combustion engine with respect to a change in the output of the airflow meter.

In FIG. 14, (A) indicates an output waveform of the airflow meter 4, a solid line of (B) indicates intake air quantity sucked into each cylinder, a dotted line of (B) indicates the amount of fuel sucked into cylinder, (C) indicates an amount of injected fuel in consideration of the fuel dynamic characteristic, (D) indicates intake air quantity (solid line) and amount of fuel supply (dotted line) within each cylinder in the case of (C), (E) shows the given amount of additional fuel supply at the time of abrupt acceleration in the third preferred embodiment, (F) indicates an amount of fuel supply to be actually sucked within each cylinder by injecting the additional amount of fuel supply, (G) indicates an amount of fuel supply obtained by a calculation result subtracting (F) from the required amount of fuel into the engine, (H) indicates an intake air quantity (solid line) within each engine cylinders as a result of total injection shown by (E) plus (G) and amount of fuel supply (dotted line).

Although it is not practical that the output of the airflow meter changes stepwise as shown in (A) of FIG. 14, the output of the airflow meter is assumed to change abruptly as shown in (A) of FIG. 14 at time $T_0$ for convenience.

If the output of the airflow meter 4 is directly used to set the amount of injected fuel as carried out in a conventional fuel supply control system, the intake air quantity and amount of fuel supply within each cylinder are shown in (B) of FIG. 14 wherein the amount of fuel supply becomes excessively small and air-fuel mixture becomes excessively lean during the interval between $T_0$ and $T_1$ and thereafter the fuel supply amount becomes excessively large during the interval between $T_1$ and $T_2$. Therefore, the air-fuel mixture becomes excessively rich. Thus, an unfavorable air fuel ratio results.

To prevent such unfavorable results the air-and-fuel dynamic characteristics within the intake air system of the engine need to be considered, so that any imbalance between the intake air quantity and amount of fuel supplied may be considerably improved as shown by (D) of FIG. 14 whenever the injection valve 5 injects the amount of fuel as shown in (C) of FIG. 14 based on the characteristic expressed in the equation (19).

However, as appreciated from (D) of FIG. 14, the timing of the fuel supply is slightly later than the intake air quantity and stability becomes worse if such a control as to make the fuel supply control earlier than the intake air quantity is performed in order to improve such an imbalance.

According to the third preferred embodiment of the present invention, the given amount of additional fuel supply is injected immediately as shown in (E) of FIG. 14 at the timing of $T_3$ ($T_3$ is followed by $T_0$) at which the throttle valve has changed its opening angle. The fuel injection valve 5 the amount of fuel shown in (G) of FIG. 14 which represents a subtraction of the additional amount of fuel actually sucked into each cylinder during abrupt acceleration as shown in (F) of FIG. 14 from the amount of fuel required within each cylinder.

Therefore, the delay of fuel supply against the intake air quantity is eliminated as shown by (H) of FIG. 14 so that the balance between the actual amount of intake air and amount of fuel supply during the transient operation described above can be maintained. In addition, the air-fuel mixture ratio can be maintained at a desired value. It should be noted that the oblique lines of (H) of FIG. 14 show the given amount of fuel additionally supplied to the engine.

If it is desirable to make the air-fuel mixture slightly richer at the time of abrupt acceleration, it is not necessary to subtract the given amount of additional fuel supply as described before from the required amount of fuel supply.

Figure 15:
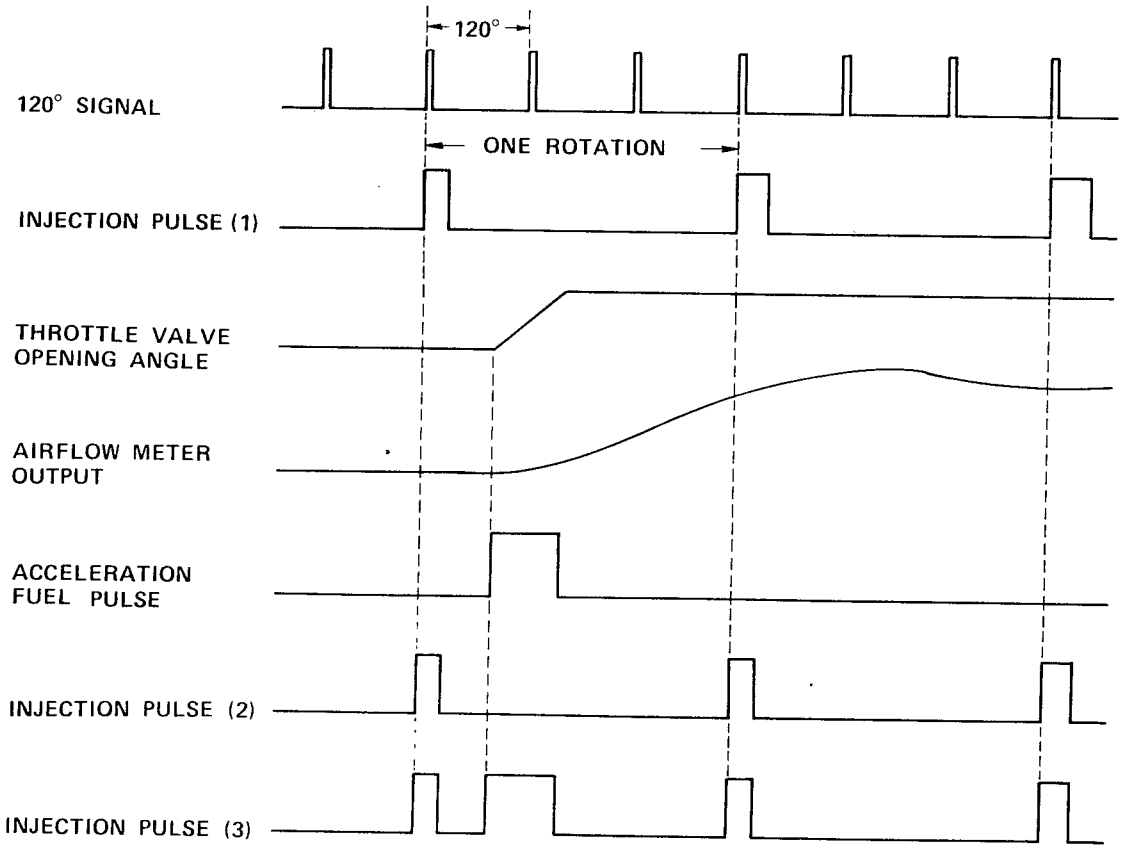
FIG. 15 is a waveform timing chart showing an output signal waveform of each circuit element of the third preferred embodiment applied to a six-cylinder internal combustion engine.

FIG. 15 depicts signal timing charts in a case where the fuel supply control system of the third preferred embodiment is applied to a six-cylinder engine.

As shown in FIG. 15, the fuel supply control system used in the six-cylinder engine is designed to operate in synchronization with a 120° signal outputted whenever the engine crankshaft rotates through 120° and the injection of fuel is carried out once at one engine rotation (360°). It should be noted that the amount of injected fuel is proportional to the pulsewidth of the fuel signal $S_3$ shown in FIG. 12.

If the throttle valve opening angle is changed as shown in FIG. 15, the output of the airflow meter changes with a slight delay after the change of the throttle opening angle. If there is no additional amount of fuel supply, the pulsewidth of the injection pulse (1), as shown in FIG. 15, is gradually increased according to the increase in the output level of the airflow meter.

At the time when the throttle valve opening angle changes, the acceleration fuel pulse as shown in FIG. 15 is outputted immediately regardless of the output timing of the 120° signal.

The injection pulse (2) shown in FIG. 15 is an injection pulse of the fuel signal $S_3$ which corresponds to the subtraction of amount sucked into each cylinder by the additional supply of fuel shown by ACCELERATION FUEL PULSE in FIG. 15 at the time of abrupt acceleration from the pulsewidth normally outputted when there is no additional supply of fuel at the time of abrupt acceleration. An actual injection pulse (3) shown in FIG. 15 is an injection pulse applied to the fuel injection valve(s) 5 which is an addition of the acceleration fuel pulse to the injection pulse (2) shown in FIG. 15.

As described hereinbefore, a fuel supply control system according to the present invention is provided which can cancel an error in the calculated amount of fuel supplied to the engine caused by the air-and-fuel dynamic characteristics in the intake air system of the engine. The control system comprises: (1) a first arithmetic operation means for calculating the actual intake air quantity sucked into each cylinder from the air dynamic characteristic and air quantity indicative signal $S_1$ of the airflow meter; (2) a second arithmetic operation means for calculating an amount of required fuel for the engine from the value obtained by the first arithmetic operation means; and (3) a third arithmetic operation means for calculating the amount of fuel to be actually supplied into each cylinder from the fuel dynamic characteristic Gf and above-described amount of required fuel for the engine.

Preferably, the fuel supply control system is constructed so that a change of engine operating condition is detected and patterns of both or either of the air-and-fuel dynamic characteristic models (the form of the arithmetic operation equation or coefficient) are selected according to the detected change of engine operating condition.

It is further preferred that the fuel supply control system is constructed so that the patterns of the dynamic characteristic models are changed according to the engine operating condition, thus controlling the air-fuel mixture ratio to a value appropriate for the current engine operating condition.

In another aspect of the invention, the fuel supply control system is constructed so that the amount of fuel supply, including the dynamic characteristics of the fuel supply control system itself, is controlled and the fuel supply at the time of acceleration is immediately increased. Thus, the amount of fuel can be increased without delay when a transient state, such as abrupt acceleration occurs, while maintaining a desired air-fuel mixture ratio. In the fuel supply control system according to an aspect of the present invention, the amount of fuel sucked into the cylinders during an abrupt acceleration is subtracted from the total fuel supply to prevent the amount of fuel supplied from being excessively large. Consequently, stable control over the air-fuel mixture ratio can be achieved.

It will be clearly understood by those skilled in the art that the foregoing description is made in terms of preferred embodiments wherein various changes and modifications may be made without departing the spirit and scope of the present invention, which is to be defined by the appended claims.

What is claimed is:

1. A system for controlling an amount of fuel supplied into an internal combustion engine having means for supplying the amount of fuel into the engine in response to a pulse signal inputted thereto, comprising:

(a) a first means for calculating an actual quantity of intake air sucked into each engine cylinder (Ac(n)) on a basis of an intake air quantity indicative signal outputted by a first sensor for detecting and signalling the intake air quantity sucked into an intake air system of the engine and an air dynamic characteristic model representing the dynamic characteristic of the intake air from the appearance of the output signal of said first sensor to the quantity of intake air actually sucked into each engine cylinder;

(b) a second means for calculating a currently required amount of fuel for each engine cylinder (Fc(n)) on a basis of a value of the actual quantity of intake air sucked into each engine cylinder obtained by said first means; and (c) a third means for calculating an amount of fuel to be currently supplied into each engine cylinder (Ff(n)) on a basis of the currently required amount of fuel for each engine cylinder calculated by said second means and a fuel dynamic characteristic model representing the dynamic characteristic of fuel from the appearance of the output fuel of said fuel supplying means to the quantity of fuel actually sucked into each cylinder by the output fuel of said fuel supplying means and outputting the pulse signal representing the amount of fuel to be currently supplied into the engine to said fuel supplying means.

2. The system of claim 1, wherein said air dynamic characteristic used in the calculation by said first means is expressed in the following equation:

$$Ga(Z) = \frac{d_1Z^{-1} + e_1Z^{-2}}{b_2Z^{-1} + c_2Z^{-2}}$$

, wherein Ga(Z) is a Ztransform of a transfer function which depicts the air dynamic characteristic and $d_1$, $e_1$, $b_2$ and $c_2$ are coefficients obtained through an experiment.

3. The system of claim 1, wherein said air dynamic characteristic used in the calculation by said first means is expressed in the following equation:

$$Ga(Z) = \frac{d_1Z^{-1} + e_1Z^{-2}}{1 + b_1Z^{-1} + c_1Z^{-2}}$$

, wherein Ga(Z) is a Z-transform of a transfer function and $d_1$, $e_1$, $b_1$, and $c_1$ are coefficients obtained through an experiment and which further comprises: (d) a fourth means for calculating a future value of the actual quantity of intake air at the subsequent period of sampling (Ac(n+1)) from the value obtained by said first means and that obtained by said first means at the immediately preceding period of sampling; and (e) a fifth means for calculating a future value of the required amount of fuel for each engine cylinder at the subsequent period of sampling Fc(n+1), whereby said third means calculates the amount of fuel to be currently supplied into the engine in consideration of the value obtained by said fifth means.

4. The system according to claim 1, wherein the form of the air dynamic characteristic model used for the calculation of the actual quantity of intake air in said first means is changed according to an engine operating environment which affects the air dynamic characteristic model.

5. The system according to claim 1, wherein the form of the fuel dynamic characteristic model used for the calculation of the amount of fuel currently supplied to the engine in said third means is changed according to an engine operating condition which affects the fuel dynamic characteristic model.

6. The system according to claim 4, wherein the engine operating environment which affects the air dynamic characteristic model is a function of the type of said first sensor used.

7. The system according to claim 4, wherein the engine operating environment which affects the air dynamic characteristic model is a function of how the intake air system of the engine is configured in the engine structure with respect to the exhaust gas system thereof.

8. The system according to claim 4, wherein the engine operating environment which affects the air dynamic characteristic model is an atmospheric pressure around the engine.

9. The system according to claim 5, wherein the engine operating condition which affects the fuel dynamic characteristic model is an intake air temperature within the intake air system of the engine.

10. The system according to claim 5, wherein the engine operating condition which affects the fuel dynamic characteristic model is a target air-fuel mixture ratio at the time of the current engine operation.

11. The system according to claim 9, wherein a target air-fuel mixture ratio at the time of the current engine operation is the engine operating condition which affects the fuel dynamic characteristic model together with the intake air temperature within the intake air system of the engine.

12. The system according to claim 5, wherein the engine operating condition which affects the fuel dynamic characteristic model is an engine cooling water temperature in a case when the fuel supply control system is applied to a cross-flow type engine.

13. The system according to claim 1, wherein the forms of both or either of the air-and-fuel characteristic models are changed according to an output signal of a second sensor for detecting and signalling an engine operating condition which requires the change of the target air-fuel mixture ratio.

14. The system according to claim 13, wherein said second sensor is a sensor which detects and signals that a throttle valve located within a throttle chamber of the intake air system of the engine is abruptly opened and wherein the forms of both or either of the air-and-fuel dynamic characteristic models are changed such that the air-fuel mixture ratio becomes smaller than the target air-fuel mixture ratio.

15. The system according to claim 14, wherein said second sensor is a sensor which detects and signals that the throttle valve is abruptly closed and wherein the forms of both or either of the air-and-fuel dynamic characteristic models are changed such that the air-fuel mixture ratio becomes larger than the target air-fuel mixture ratio.

16. The system according to claim 3, which further comprises: (f) sixth means for detecting and signalling that the currently required amount of fuel for each engine cylinder according to the actual quantity of intake air sucked into each engine cylinder is abruptly increased; and (g) a seventh means for outputting the pulse signal to said fuel supplying means in response to the output signal from said sixth means so that a given amount of fuel by the pulse signal sent from said seventh means to said fuel supplying means is additionally supplied into each cylinder, whereby air-fuel mixture having a desired air-fuel mixture ratio can be supplied into each engine cylinder.

17. The system according to claim 16, wherein said sixth means comprises a third sensor which generates a signal, a level of which accords with a rate of change in an opening angle of a throttle valve and outputs the signal to said seventh means when the rate of change in the opening angle of the throttle valve increases toward the full open position.

18. The system according to claim 17, wherein said seventh means outputs the pulse signal to said fuel supplying means in response to the output signal from said third sensor, the pulse signal having a constant pulsewidth.

19. The system according to claim 17, wherein said seventh means outputs the pulse signal to said fuel supplying means in response to the output signal from said third sensor, the pulse signal having a pulsewidth, the pulsewidth thereof being changed according to the level of the output signal from said third sensor.

20. The system according to claim 16, which further comprises: (h) an eighth means for calculating an amount of fuel actually sucked into each engine cylinder by the pulse signal sent from said seventh means to said fuel supplying means using the fuel dynamic characteristic model; and (i) a ninth means, intervened between said third means and fuel supplying means, for calculating the subtraction of the calculated amount of fuel by said eighth means from the currently supplied amount of fuel calculated by said third means and outputting the pulse signal according to the subtracted result to said fuel supplying means.

21. A system for controlling an amount of fuel supplied to an internal combustion engine, comprising:

(a) a first means for detecting and signalling a quantity of air sucked into an intake air passage of the engine;

(b) a second means for storing at least one first dynamic characteristic model expressing a transfer function defining a dynamic characteristic between a detected air quantity value from said first means and intake air quantity value actually sucked into each engine cylinder;

(c) a third means for calculating an actual quantity of intake air sucked into each engine cylinder from the detected quantity of air by said first means and from the first dynamic characteristic model stored within said second means;

(d) a fourth means for storing a second dynamic characteristic model expressing a transfer function defining a dynamic characteristic between a fuel signal corresponding to an amount of fuel required for the engine calculated from the air quantity value of said first means and from other engine operating variables and an actual amount of fuel sucked into each engine cylinder;

(e) fifth means for calculating the amount of fuel required for the engine using an intake air quantity calculated by said third means;

(f) sixth means for calculating an amount of fuel to be supplied at the time of the present sampling period from the required amount of fuel calculated from said fifth means and from the second dynamic characteristic model stored within said fourth means and outputting the fuel signal according to the calculated result thereby; and (g) seventh means, responsive to the calculated result, for supplying the amount of fuel calculated by said sixth means into the engine.

22. The system according to claim 21, which further comprises seventh means for calculating the intake air quantity at the time of a subsequent sampling period on a basis of the intake air quantities calculated by said third means at the times of the present sampling period and the immediately preceding sampling period and wherein said fifth means calculates the amount of fuel required for the engine using the intake air quantity calculated by said seventh means at the time of the subsequent sampling period.

23. The system according to claim 21, wherein both forms of the first and second dynamic characteristic models stored within said second means and fourth means is selectively changed according to changes in engine operating conditions.

24. The system according to claim 21, wherein either of forms of the first and second dynamic characteristic models stored within said second and fourth means is selectively changed according to a changes in engine operating conditions.

25. The system according to claim 23, wherein the forms of the first and second dynamic characteristic models stored within said second and fourth means are selectively changed according to an intake air temperature and basic air-fuel mixture ratio determined at the current engine operating state.

26. The system according to claim 23, wherein the forms of the first and second dynamic characteristic models stored within said second and fourth means are selectively changed according to an engine cooling water temperature.

27. The system according to claim 24, wherein the form of the second dynamic characteristic model stored within said fourth means is changed depending on whether said seventh means is installed in the vicinity of an intake valve of each cylinder or installed within a throttle chamber.

28. The system according to claim 24, wherein the form of the first dynamic characteristic model stored within said second means is changed depending on the construction of intake and exhaust pipes and atmospheric pressure.

29. The system according to claim 21, which further comprises eighth means for detecting and signalling an engine operating condition which needs to change an air-fuel mixture ratio of the engine and ninth means for selecting both or either of the first and second dynamic characteristic models stored within said second and fourth means in response to a signal from said eighth means, whereby said third means calculates the intake air quantity actually sucked into the engine cylinder.

30. The system according to claim 29, wherein said eighth means comprises a sensor for detecting and signalling that a throttle valve of the engine is abruptly opened.

31. The system according to claim 21, which further comprises tenth means for detecting and signalling a state in which the amount of fuel required for the engine is abruptly increased and wherein said seventh means supplies an additional amount of fuel in addition to the amount of fuel calculated by said sixth means when said tenth means detects and signals the state.

32. The system according to claim 31, wherein the additional amount of fuel supplied by said seventh means is a constant value.

33. The system according to claim 31, wherein the additional amount of fuel supplied by said seventh means is varied according to an increasing state of the amount of fuel required for the engine.

34. The system according to claim 31, which further comprises eleventh means for calculating an amount of fuel actually sucked into each engine cylinder for the additional amount of fuel supplied by said seventh means on a basis of the second characteristic model stored within said fourth means and wherein said seventh means supplies the calculated amount of fuel to the engine on a basis of the subtraction of a value calculated by said sixth means from that calculated by said eleventh means.

35. A method for controlling an amount of fuel supplied to an internal combustion engine, comprising the steps of:

(a) reading output values indicative of intake air quantities sucked into an intake air pipe of the engine at the previous sampling periods;

(b) calculating an actual intake air quantity sucked into each engine cylinder from the read output values at the step (a) and at least one first dynamic characteristic model expressing a transfer function between one of the read output values and corresponding intake air quantity actually sucked into each engine cylinder;

(c) calculating an amount of fuel to be supplied into the engine required at the present sampling period using the intake air quantity calculated atthe step (b);

(d) calculating an amount of fuel to be actually supplied into the engine from the required amount of fuel calculated at the step (c) and at least one second dynamic characteristic model expressing a transfer function defined between a signal corresponding to the required amount of fuel calculated at the step (c) and amount of fuel actually sucked into each engine cylinder; and (e) supplying an amount of fuel calculated at the step (d).

36. A method for controlling an amount of fuel supplied to an internal combustion engine, comprising the steps of:

(a) reading output values indicative of intake air quantities sucked into an intake air pipe of the engine measured at the previous sampling periods;

(b) calculating an actual intake air quantity sucked into each engine cylinder from the read output values at the step (a) and at least one first dynamic characteristic model expressing a transfer function defined between one of the read output values and corresponding intake air quantity and calculating the actual intake air quantity at the subsequent sampling period from the actual intake air quantities calculated at the previous sampling periods;

(c) calculating an amount of fuel to be supplied into the engine required at the subsequent sampling period using the actual intake air quantity at the subsequent sampling period and other engine operating variables;

(d) calculating an amount of fuel to be supplied into the engine required at the current sampling period from the amount of fuel required at the current, previous, and subsequent sampling periods calculated at the step (c) and at least one second dynamic characteristic model expressing a transfer function defined between a signal corresponding to the required amount of fuel calculated at the step (c) and actual amount of fuel sucked into each engine cylinder; and (e) supplying an amount of fuel calculated at the step (d) into the engine.

37. The method according to claim 35, which further comprises the following step (f) between the steps (a) and (b): selecting at least one form of the first and second dynamic characteristic models based on the steps (b) and (d) according to a changes in engine operating conditions.

38. The method according to claim 35, which further comprises the following step (g) between steps (d) and (e): supplying an additional amount of fuel when a state in which the amount of fuel required for the engine is abruptly increased is detected.

39. The method according to claim 29, wherein the step (e) is carried out unconditionally when the state in which the amount of fuel required for the engine is abruptly increased is not detected.

40. The method according to claim 29, wherein the step (e) is carried out on condition that the amount of fuel to be supplied into the engine is based on the subtraction calculated at the step (d) from the additional amount of fuel carried out at the step (g).

* * * * *